US010968499B2

(12) United States Patent
Mizutani et al.

(10) Patent No.: US 10,968,499 B2
(45) Date of Patent: Apr. 6, 2021

(54) FERRITIC STAINLESS STEEL AND PROCESS FOR PRODUCING SAME

(71) Applicant: JFE STEEL CORPORATION, Tokyo (JP)

(72) Inventors: Akito Mizutani, Tokyo (JP); Masataka Yoshino, Tokyo (JP); Mitsuyuki Fujisawa, Tokyo (JP); Ayako Ta, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 822 days.

(21) Appl. No.: 15/531,562

(22) PCT Filed: Jul. 2, 2015

(86) PCT No.: PCT/JP2015/003335

§ 371 (c)(1),
(2) Date: May 30, 2017

(87) PCT Pub. No.: WO2016/092714

PCT Pub. Date: Jun. 16, 2016

(65) Prior Publication Data

US 2017/0327921 A1 Nov. 16, 2017

(30) Foreign Application Priority Data

Dec. 11, 2014 (JP) ..... JP2014-251178

(51) Int. Cl.

| | |
|---|---|
| ***C21D 9/46*** | (2006.01) |
| ***C22C 38/54*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/40*** | (2006.01) |
| ***C21D 6/00*** | (2006.01) |

(52) U.S. Cl.

CPC ..... *C21D 9/46* (2013.01); *C21D 6/002* (2013.01); *C21D 6/004* (2013.01); *C21D 6/005* (2013.01); *C21D 6/007* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 8/0273* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/40* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/005* (2013.01); *C21D 2211/008* (2013.01)

(58) Field of Classification Search

CPC ..... C21D 9/46; C22C 38/00; C22C 38/001; C22C 38/002; C22C 38/02; C22C 38/04; C22C 38/06; C22C 38/40; C22C 38/42; C22C 38/44; C22C 38/46; C22C 38/48; C22C 38/50; C22C 38/52; C22C 38/54; C22D 2211/005

See application file for complete search history.

(56) References Cited

U.S. PATENT DOCUMENTS

| | | | |
|---|---|---|---|
| 9,771,640 | B2 | 9/2017 | Hatano et al. |
| 2015/0376732 | A1 | 12/2015 | Hamada et al. |

FOREIGN PATENT DOCUMENTS

| | | | | |
|---|---|---|---|---|
| CN | 103608479 | A | 2/2014 | |
| EP | 1099773 | A1 | 5/2001 | |
| EP | 1413640 | A1 | 4/2004 | |
| EP | 3093362 | A1 | 11/2016 | |
| JP | S5527129 | B2 | 7/1980 | |
| JP | H06271944 | A | 9/1994 | |
| JP | H08291332 | A * | 11/1996 | ..... B21B 3/02 |
| JP | H08291332 | A | 11/1996 | |

(Continued)

OTHER PUBLICATIONS

JP H08291332 Espacenet Machine Translation (Year: 2020).*

(Continued)

*Primary Examiner* — Alexandra M Moore

(74) *Attorney, Agent, or Firm* — Kenja IP Law PC

(57) ABSTRACT

Ferritic stainless steel that has excellent formability and ridging resistance and can be produced with high productivity is provided. The ferritic stainless steel has: a predetermined chemical composition; a microstructure containing ferrite crystal grains which satisfy at least one of a C concentration of $2C_C$ or more and an N concentration of $2C_N$ or more, the ferrite crystal grains having a volume fraction with respect to a whole volume of the microstructure of 5% or more and 50% or less, where $C_C$ and $C_N$ are respectively C content and N content in the steel in mass %; and a Vickers hardness of 180 or less.

9 Claims, No Drawings

(56) References Cited

FOREIGN PATENT DOCUMENTS

| | | | | | |
|---|---|---|---|---|---|
| JP | H09111354 | A | | 4/1997 | |
| JP | 2001089814 | A | | 4/2001 | |
| JP | 2001098327 | A | | 4/2001 | |
| JP | 2001098328 | A | | 4/2001 | |
| JP | 2008195985 | A | * | 8/2008 | ..... F28F 21/083 |
| JP | 2009275268 | A | | 11/2009 | |
| JP | 5505555 | B1 | * | 5/2014 | |
| KR | 1020100058851 | A | | 6/2010 | |
| TW | 201435098 | A | | 9/2014 | |
| WO | 2014147655 | A1 | | 9/2014 | |

OTHER PUBLICATIONS

Machine Translation JP 2008-195985 A (Year: 2020).*

JP-5505555-B1 Machine Translation (Also known as WO2014147655 or JPWO2014147655) (Year: 2021).*

Aug. 9, 2018, Office Action issued by the Korean Intellectual Property Office in the corresponding Korean Patent Application No. 10-2017-7017048 with English language concise statement of relevance.

Oct. 9, 2018, Office Action issued by the State Intellectual Property Office in the corresponding Chinese Patent Application No. 201580067091.3 with English language concise statement of relevance.

Sep. 15, 2017, Extended European Search Report issued by the European Patent Office in the corresponding European Patent Application No. 15867886.2.

Mar. 4, 2019, Office Action issued by the State Intellectual Property Office in the corresponding Chinese Patent Application No. 201580067091.3 with English language concise statement of relevance.

Sep. 15, 2015, International Search Report issued in the International Patent Application No. PCT/ JP2015/003335.

Jan. 13, 2016, Office Action issued by the Taiwan Intellectual Property Office in the corresponding Taiwanese Patent Application No. 104122002 with English language search report.

Mar. 29, 2018, Office Action issued by the State Intellectual Property Office in the corresponding Chinese Patent Application No. 201580067091.3 with English language Search Report.

Nov. 6, 2020, Office Action issued by the China National Intellectual Property Administration in the corresponding Chinese Patent Application No. 201580067091.3 with English language concise statement of relevance.

Jul. 27, 2020, Office Action issued by the China National Intellectual Property Administration in the corresponding Chinese Patent Application No. 201580067091.3 with English language concise statement of relevance.

* cited by examiner

FERRITIC STAINLESS STEEL AND PROCESS FOR PRODUCING SAME

TECHNICAL FIELD

The disclosure relates to ferritic stainless steel having excellent formability and ridging resistance.

BACKGROUND

Ferritic stainless steel, such as SUS430, is economical and has excellent corrosion resistance, and so has been used in home appliances, kitchen instruments, etc. In recent years, the use of ferritic stainless steel in cooking utensils compatible with induction heating (IH) has been on the increase, as ferritic stainless steel is magnetic. Cooking wares such as pans are often made by bulging, and sufficient elongation is needed to form a predetermined shape.

Surface appearance also significantly affects the commercial value of cooking pans and the like. Typically, when forming ferritic stainless steel into a product, surface roughness called ridging appears, degrading the surface appearance of the formed product. In the case where excessive ridging occurs, polishing is required after the formation to remove the roughness, which increases production cost. Ridging therefore needs to be reduced. Ridging derives from an aggregate (hereafter also referred to as "ferrite colony" or "colony") of ferrite grains having similar crystal orientations. It is believed that a coarse columnar crystallite generated during casting is elongated by hot rolling, and the elongated grains or grain group remains even after hot-rolled sheet annealing, cold rolling, and cold-rolled sheet annealing, thus forming a colony.

In view of the aforementioned problem, for example, JP 2001-98328 A (PTL 1) discloses "a method for producing ferritic stainless steel, the method comprising: heating a steel raw material containing, in mass %, C: 0.02% to 0.12%, N: 0.02% to 0.12%, Cr: 16% to 18%, V: 0.01% to 0.15%, and Al: 0.03% or less; hot rolling the steel raw material so that a finisher delivery temperature FDT is 1050° C. to 750° C.; starting cooling within 2 sec after the hot rolling ends; coiling after cooling to 550° C. or less at a cooling rate of 10° C./s to 150° C./s, to form a ferrite and martensite microstructure; or further performing a preliminary rolling step of cold or warm rolling at a rolling reduction of 2% to 15%; and performing hot-rolled sheet annealing". Here, instead of quenching after the hot rolling, quenching may be performed after the coiling to form the ferrite and martensite microstructure.

JP 2009-275268 A (PTL 2) discloses "a cold rolled ferritic stainless steel sheet comprising: a chemical composition containing, in mass %, C: 0.01% to 0.08%, Si: 0.30% or less, Mn: 0.30% to 1.0%, P: 0.05% or less, S: 0.01% or less, Al: 0.02% or less, N: 0.01% to 0.08%, and Cr: 16.0% to 18.0%, with a balance being Fe and incidental impurities; and a microstructure made up of ferrite crystal grains in which Cr carbonitride is precipitated, wherein in a section defined by a rolling direction and a sheet thickness direction, a ratio Dz/Dl between a mean ferrite crystal grain size Dz in the sheet thickness direction and a mean ferrite crystal grain size Dl in the rolling direction is 0.7 or more, and an area ratio Sp of the Cr carbonitride occupying an observation field is 2% or more and a mean equivalent circular diameter Dp of the Cr carbonitride is 0.5 μm or more". Here, Sp and Dp of the Cr carbonitride are observed by a scanning electron microscope (SEM) at 2,000 magnifications.

CITATION LIST

Patent Literatures

PTL 1: JP 2001-98328 A
PTL 2: JP 2009-275268 A

SUMMARY

Technical Problem

However, the method described in PTL 1 needs to perform preliminary rolling before hot-rolled sheet annealing in the steel sheet production, which increases the rolling load and decreases productivity.

The steel sheet described in PTL 2 has coarse Cr carbonitride precipitated in the final annealed sheet with a mean equivalent circular diameter of 0.5 μm or more, and so there is a possibility of surface defects depending on the working condition when working the steel sheet into a product.

It could be helpful to provide ferritic stainless steel that has excellent formability and ridging resistance and can be produced with high productivity, and a process for producing the same.

Here, "excellent formability" means that the elongation after fracture (El) of a test piece whose longitudinal direction is the direction (hereafter also referred to as "orthogonal direction") orthogonal to the rolling direction is 25% or more, preferably 28% or more, and more preferably 30% or more, in a tensile test according to JIS Z 2241.

Meanwhile, "excellent ridging resistance" means that the ridging height measured by the following method is 2.5 μm or less. First, a JIS No. 5 tensile test piece is collected in the rolling direction. After polishing the surface of the collected test piece using #600 emery paper, a tensile strain of 20% is added to the test piece. The arithmetic mean waviness Wa defined in JIS B 0601 (2001) is then measured by a surface roughness meter on the polished surface at the center of the parallel portion of the test piece, in the direction orthogonal to the rolling direction. The measurement conditions are a measurement length of 16 mm, a high-cut filter wavelength of 0.8 mm, and a low-cut filter wavelength of 8 mm. This arithmetic mean waviness is set as the ridging height.

Solution to Problem

We repeatedly conducted intensive study. In particular, to improve productivity, we intensively studied a method for ensuring excellent formability and ridging resistance not by long-time hot-rolled sheet annealing through currently commonly used box annealing (batch annealing) but by short-time hot-rolled sheet annealing using a continuous annealing furnace.

As a result, we discovered that, even in the case of performing short-time hot-rolled sheet annealing using a continuous annealing furnace, a ferrite colony formed in the casting stage can be effectively destroyed by generating a predetermined amount of martensite phase during the hot-rolled sheet annealing and performing cold rolling in this state.

We also discovered that, by subjecting the cold rolled sheet obtained in this way to cold-rolled sheet annealing in the ferrite single phase temperature region, a multi-phase of ferrite crystal grains (hereafter also referred to as "C/N-concentrated grains") that originate from the martensite phase generated in the hot-rolled sheet annealing and in which at least one of C and N concentrates and ferrite crystal grains (hereafter also referred to simply as "non-concentrated grains") that originate from the part which remains to be the ferrite phase even during the hot-rolled sheet annealing and have a low carbonitride concentration is obtained, thus achieving both excellent ridging resistance and excellent formability. We further discovered that an appropriate criterion for determining whether or not at least one of C and N concentrates in the ferrite crystal grains is that at least one of the C concentration and N concentration in the ferrite crystal grains is not less than twice a corresponding one of the C content and N content (mass %) in the steel.

Since a large amount of fine carbonitride precipitates in the C/N-concentrated grains during the cold-rolled sheet annealing, grain growth during the annealing is suppressed by the pinning effect, as a result of which the accumulation of a ferrite colony is prevented and ridging resistance is improved. Meanwhile, the C/N concentration is lower in the non-concentrated grains, which facilitates grain growth and improves elongation, that is, formability.

The disclosure is based on the aforementioned discoveries and further studies.

We provide the following:

1. A ferritic stainless steel comprising: a chemical composition containing (consisting of), in mass %, C: 0.005% to 0.050%, Si: 0.01% to 1.00%, Mn: 0.01% to 1.0%, P: 0.040% or less, S: 0.010% or less, Cr: 15.5% to 18.0%, Ni: 0.01% to 1.0%, Al: 0.001% to 0.10%, and N: 0.005% to 0.06%, with a balance being Fe and incidental impurities; a microstructure containing ferrite crystal grains which satisfy at least one of a C concentration of $2C_C$ or more and an N concentration of $2C_N$ or more, the ferrite crystal grains having a volume fraction with respect to a whole volume of the microstructure of 5% or more and 50% or less, where $C_C$ and $C_N$ are respectively C content and N content in the steel in mass %; and a Vickers hardness of 180 or less.

2. The ferritic stainless steel according to 1., wherein the chemical composition further contains, in mass %, one or more selected from Cu: 0.01% to 1.0%, Mo: 0.01% to 0.5%, and Co: 0.01% to 0.5%.

3. The ferritic stainless steel according to 1. or 2., wherein the chemical composition further contains, in mass %, one or more selected from V: 0.01% to 0.25%, Ti: 0.001% to 0.10%, Nb: 0.001% to 0.10%, Ca: 0.0002% to 0.0020%, Mg: 0.0002% to 0.0050%, B: 0.0002% to 0.0050%, and REM: 0.01% to 0.10%.

4. The ferritic stainless steel according to any one of 1. to 3., wherein in the chemical composition, C content is 0.005 mass % to 0.030 mass %, Si content is 0.25 mass % or more and less than 0.40 mass %, and Mn content is 0.05 mass % to 0.35 mass %, the volume fraction of the ferrite crystal grains is 5% or more and 30% or less, and the ferritic stainless steel further comprises elongation after fracture in a direction orthogonal to a rolling direction is 28% or more, and a ridging height is 2.5 μm or less.

5. The ferritic stainless steel according to any one of 1. to 3., wherein in the chemical composition, C content is 0.005 mass % to 0.025 mass %, Si content is 0.05 mass % or more and less than 0.25 mass %, Mn content is 0.60 mass % to 0.90 mass %, and N content is 0.005 mass % to 0.025 mass %, the volume fraction of the ferrite crystal grains is 5% or more and 20% or less, and the ferritic stainless steel further comprises elongation after fracture in a direction orthogonal to a rolling direction is 30% or more, and a ridging height is 2.5 μm or less.

6. A process for producing the ferritic stainless steel according to any one of 1. to 5., the process comprising: hot rolling a steel slab having the chemical composition according to any one of 1. to 5. into a hot rolled sheet; performing hot-rolled sheet annealing by holding the hot rolled sheet at a temperature of 900° C. or more and 1050° C. or less for 5 seconds to 15 minutes, to form a hot-rolled and annealed sheet; cold rolling the hot-rolled and annealed sheet into a cold rolled sheet; and performing cold-rolled sheet annealing by holding the cold rolled sheet at a temperature of 800° C. or more and less than 900° C. for 5 seconds to 5 minutes.

7. The process for producing the ferritic stainless steel according to 6., wherein in the chemical composition, C content is 0.005 mass % to 0.030 mass %, Si content is 0.25 mass % or more and less than 0.40 mass %, and Mn content is 0.05 mass % to 0.35 mass %, the holding temperature in the hot-rolled sheet annealing is 940° C. or more and 1000° C. or less, and the holding temperature in the cold-rolled sheet annealing is 820° C. or more and less than 880° C.

8. The process for producing the ferritic stainless steel according to 6., wherein in the chemical composition, C content is 0.005 mass % to 0.025 mass %, Si content is 0.05 mass % or more and less than 0.25 mass %, Mn content is 0.60 mass % to 0.90 mass %, and N content is 0.005 mass % to 0.025 mass %, the holding temperature in the hot-rolled sheet annealing is 960° C. or more and 1050° C. or less, and the holding temperature in the cold-rolled sheet annealing is 820° C. or more and less than 880° C.

Advantageous Effect

It is thus possible to obtain ferritic stainless steel having excellent formability and ridging resistance.

Such ferritic stainless steel is very advantageous in terms of productivity, as it can be produced not by long-time hot-rolled sheet annealing through box annealing (batch annealing) but by short-time hot-rolled sheet annealing using a continuous annealing furnace.

DETAILED DESCRIPTION

The following describes one of the disclosed embodiments in detail.

The reasons why the ferritic stainless steel according to the disclosure has excellent formability and ridging resistance are described first.

To improve the ridging resistance of stainless steel, it is effective to destroy a ferrite colony, which is an aggregate of crystal grains having similar crystal orientations.

We conducted repeated study to ensure excellent formability and ridging resistance not by long-time hot-rolled sheet annealing through currently commonly used box annealing (batch annealing) but by short-time hot-rolled sheet annealing using a continuous annealing furnace, for productivity. As a result, we discovered the following; Heating to the dual phase temperature region of the ferrite phase and austenite phase during hot-rolled sheet annealing facilitates recrystallization and also generates the austenite phase, which secures a predetermined amount of martensite phase after the hot-rolled sheet annealing. The ferrite colony is destroyed efficiently by cold rolling the hot-rolled and annealed sheet which includes the predetermined amount of martensite phase, since a rolling strain is effectively added to the ferrite phase during cold rolling.

We also discovered that, by appropriately controlling the chemical composition, the hot-rolled sheet annealing condition, and the cold-rolled sheet annealing condition to make the microstructure of the cold-rolled and annealed sheet a multi-phase of C/N-concentrated grains and non-concentrated grains, ridging resistance is further improved and sufficient formability is achieved. The C/N-concentrated grains are ferrite grains resulting from the decomposition of martensite generated during the hot-rolled sheet annealing. When the steel sheet is heated to the (ferrite-austenite) dual phase region during the hot-rolled sheet annealing, C and N concentrates in the austenite phase which has a greater solid solubility limit than the ferrite phase. After this, when the steel sheet is cooled, the austenite phase transforms to the martensite phase in which C and/or N concentrates. By annealing the hot-rolled and annealed sheet including such martensite phase in the ferrite single phase temperature region after cold rolling, the martensite phase is decomposed to obtain the C/N-concentrated grains. Since a large amount of carbonitride precipitates in the C/N-concentrated grains, grain growth is inhibited during cold-rolled sheet annealing by the pinning effect. This prevents excessive ferrite grain microstructure accumulation and significantly improves ridging resistance. This effect is achieved when at least one of the C concentration and N concentration is not less than twice the corresponding content (mass %) in the steel. On the other hand, the ferrite grains (non-concentrated grains) other than the C/N-concentrated grains have a C concentration and N concentration that are lower than the corresponding contents (mass %) in the steel, which facilitates grain growth during the cold-rolled sheet annealing and improves elongation. Excellent ridging resistance and sufficient formability can both be achieved in this way.

In the case where the volume fraction of the C/N-concentrated grains increases to a predetermined fraction or more, however, strength increases excessively and elongation after fracture decreases. We accordingly conducted detailed study on such a volume fraction of the C/N-concentrated grains that contributes to excellent formability and ridging resistance.

As a result, we discovered that, by controlling the volume fraction of the C/N-concentrated grains after the cold-rolled sheet annealing to be in the range of 5% to 50% with respect to the whole volume of the microstructure, predetermined formability and ridging resistance can be attained without a decrease in elongation after fracture caused by an increase in steel sheet strength. Particularly in the case of taking the balance between formability and ridging resistance into consideration, the volume fraction of the C/N-concentrated grains is preferably 5% or more and 30% or less with respect to the whole volume of the microstructure. In terms of attaining better formability, the volume fraction of the C/N-concentrated grains is preferably 5% or more and 20% or less with respect to the whole volume of the microstructure. The microstructure other than the ferrite grains made up of the C/N-concentrated grains is basically the ferrite grains made up of the non-concentrated grains, although other structures (e.g. martensite phase) are allowable if their total volume fraction is less than 1% with respect to the whole volume of the microstructure.

If the holding temperature or holding time in the cold-rolled sheet annealing is insufficient, not only the recrystallization of ferrite grains is insufficient but also the decomposition of the martensite phase generated during the hot-rolled sheet annealing is insufficient, resulting in a decrease in elongation. To attain sufficient formability, it is necessary to sufficiently complete recrystallization after the cold-rolled sheet annealing and sufficiently decompose the martensite phase generated during the hot-rolled sheet annealing. In the case where the holding temperature in the cold-rolled sheet annealing is too high, on the other hand, the martensite phase newly generates, which causes a decrease in elongation. Hence, the amount of martensite phase which is present needs to be limited. The volume fraction of the martensite phase needs to be less than 1% with respect to the whole volume of the microstructure. To attain excellent formability, the volume fraction of the martensite phase is preferably 0%.

As a result of our study, we found out that such problems can be solved to obtain an appropriate microstructure by appropriately controlling the cold-rolled sheet annealing condition so that the Vickers hardness is 180 or less. The Vickers hardness is preferably 165 or less.

The reasons for limiting the chemical composition of the ferritic stainless steel according to the disclosure are described next. While the unit of the content of each element in the chemical composition is "mass %," the unit is hereafter simply expressed by "%" unless otherwise specified.

C: 0.005% to 0.050%

C is an important element to generate the C/N-concentrated grains and improve ridging resistance. C also has an effect of facilitating the generation of the austenite phase and expanding the dual phase temperature region of the ferrite phase and the austenite phase during hot-rolled sheet annealing. To achieve these effects, the C content needs to be 0.005% or more. If the C content is more than 0.050%, the steel sheet hardens and predetermined elongation after fracture cannot be attained. The C content is therefore in the range of 0.005% to 0.050%. In terms of further improving elongation after fracture and attaining excellent formability, depending on the below-mentioned Si content and Mn content, the C content is preferably 0.005% or more and 0.030% or less. Alternatively, the C content is preferably 0.005% or more and 0.025% or less. The C content is more preferably 0.008% or more and 0.025% or less. The C content is further preferably 0.010% or more. The C content is further preferably 0.020% or less.

Si: 0.01% to 1.00%

Si is an element that functions as a deoxidizer in steelmaking. To achieve this effect, the Si content needs to be 0.01% or more. If the Si content is more than 1.00%, the steel sheet hardens and predetermined elongation after fracture cannot be attained. Besides, surface scale formed during annealing becomes firm and pickling is difficult, which is not preferable. The Si content is therefore in the range of 0.01% to 1.00%. The Si content is preferably 0.05% or more. The Si content is preferably 0.75% or less. The Si content is further preferably 0.05% or more. The Si content is further preferably 0.40% or less.

In the case where the below-mentioned Mn content is in the range of 0.05% to 0.35%, in terms of further improving elongation after fracture to attain excellent formability while ensuring predetermined ridging resistance, the Si content is preferably 0.25% or more and less than 0.40%.

In the case where the below-mentioned Mn content is in the range of 0.60% to 0.90%, in terms of further improving elongation after fracture to attain excellent formability while ensuring predetermined ridging resistance, the Si content is preferably 0.05% or more and less than 0.25%.

Mn: 0.01% to 1.0%

Mn has an effect of facilitating the generation of the austenite phase and expanding the dual phase temperature region of the ferrite phase and the austenite phase during hot-rolled sheet annealing, as with C. To achieve this effect, the Mn content needs to be 0.01% or more. If the Mn content is more than 1.0%, the amount of MnS generated increases, leading to lower corrosion resistance. The Mn content is therefore in the range of 0.01% to 1.0%. The Mn content is preferably 0.05% or more. The Mn content is preferably 0.90% or less.

As mentioned above, in the case where the Si content is 0.25% or more and less than 0.40%, in terms of further improving elongation after fracture to attain excellent formability while ensuring predetermined ridging resistance, the Mn content is preferably 0.05% or more and 0.35% or less.

In the case where the Si content is 0.05% or more and less than 0.25%, in terms of further improving elongation after fracture to attain excellent formability while ensuring predetermined ridging resistance, the Mn content is preferably 0.60% or more and 0.90% or less. The Mn content is more preferably 0.70% or more and 0.90% or less. The Mn content is further preferably 0.75% or more. The Mn content is further preferably 0.85% or less.

P: 0.040% or Less

P is an element that promotes intergranular fracture by grain boundary segregation, and so is desirably low in content. The upper limit of the P content is 0.040%. The P content is preferably 0.030% or less. The P content is further preferably 0.020% or less. The lower limit of the P content is not particularly limited, but is about 0.010% in terms of production cost and the like.

S: 0.010% or Less

S is an element that is present as a sulfide inclusion such as MnS and decreases ductility, corrosion resistance, etc. The adverse effects are noticeable particularly in the case where the S content is more than 0.010%. Accordingly, the S content is desirably as low as possible. The upper limit of the S content is 0.010%. The S content is preferably 0.007% or less. The S content is further preferably 0.005% or less. The lower limit of the S content is not particularly limited, but is about 0.001% in terms of production cost and the like.

Cr: 15.5% to 18.0%

Cr is an element that has an effect of forming a passive layer on the steel sheet surface and improving corrosion resistance. To achieve this effect, the Cr content needs to be 15.5% or more. If the Cr content is more than 18.0%, the generation of the austenite phase during hot-rolled sheet annealing is insufficient, making it impossible to attain predetermined material characteristics. The Cr content is therefore in the range of 15.5% to 18.0%. The Cr content is preferably 16.0% or more. The Cr content is preferably 17.5% or less. The Cr content is further preferably 16.5% or more. The Cr content is further preferably 17.0% or less.

Ni: 0.01% to 1.0%

Ni has an effect of facilitating the generation of the austenite phase and expanding the dual phase temperature region where the ferrite phase and the austenite phase appear during hot-rolled sheet annealing, as with C and Mn. To achieve this effect, the Ni content needs to be 0.01% or more. If the Ni content is more than 1.0%, workability decreases. The Ni content is therefore in the range of 0.01% to 1.0%. The Ni content is preferably 0.1% or more. The Ni content is preferably 0.6% or less. The Ni content is further preferably 0.1% or more. The Ni content is further preferably 0.4% or less.

Al: 0.001% to 0.10%

Al is an element that functions as a deoxidizer, as with Si. To achieve this effect, the Al content needs to be 0.001% or more. If the Al content is more than 0.10%, an Al inclusion such as $Al_2O_3$ increases, which is likely to cause lower surface characteristics. The Al content is therefore in the range of 0.001% to 0.10%. The Al content is preferably 0.001% or more. The Al content is preferably 0.05% or less. The Al content is further preferably 0.001% or more. The Al content is further preferably 0.03% or less.

N: 0.005% to 0.06%

N is an important element to generate C/N-concentrated grains and improve ridging resistance. N also has an effect of facilitating the generation of the austenite phase and expanding the dual phase temperature region where the ferrite phase and the austenite phase appear during hot-rolled sheet annealing. To achieve these effects, the N content needs to be 0.005% or more. If the N content is more than 0.06%, not only ductility decreases significantly, but also the precipitation of Cr nitride is promoted to cause lower corrosion resistance. The N content is therefore in the range of 0.005% to 0.06%. The N content is preferably 0.005% or more. The N content is preferably 0.05% or less. The N content is more preferably 0.005% or more. The N content is more preferably 0.025% or less. The N content is further preferably 0.010% or more. The N content is further preferably 0.025% or less. The N content is still further preferably 0.010% or more. The N content is still further preferably 0.020% or less.

In particular, in the case where the C content is 0.005% to 0.025%, the Si content is 0.05% or more and less than 0.25%, and the Mn content is 0.60% to 0.90%, the N content is preferably 0.005% or more and 0.025% or less. The N content is more preferably 0.010% or more and 0.025% or less. The N content is further preferably 0.010% or more and 0.020% or less.

While the basic components have been described above, the ferritic stainless steel according to the disclosure may contain the following elements as appropriate according to need, in order to improve manufacturability or material characteristics.

One or more selected from Cu: 0.01% to 1.0%, Mo: 0.01% to 0.5%, and Co: 0.01% to 0.5%

Cu: 0.01% to 1.0%, Mo: 0.01% to 0.5%

Cu and Mo are each an element that improves corrosion resistance, and is effectively contained particularly in the case where high corrosion resistance is required. Cu also has an effect of facilitating the generation of the austenite phase and expanding the dual phase temperature region where the ferrite phase and the austenite phase appear during hot-rolled sheet annealing. The effect(s) is achieved when the Cu content or the Mo content is 0.01% or more. If the Cu content is more than 1.0%, hot workability may decrease, which is not preferable. Accordingly, in the case where Cu is contained, the Cu content is in the range of 0.01% to 1.0%. The Cu content is preferably 0.2% or more. The Cu content is preferably 0.8% or less. The Cu content is further preferably 0.3% or more. The Cu content is further preferably 0.5% or less. If the Mo content is more than 0.5%, the generation of the austenite phase during annealing is insufficient and predetermined material characteristics cannot be attained, which is not preferable. Accordingly, in the case where Mo is contained, the Mo content is in the range of 0.01% to 0.5%. The Mo content is preferably 0.2% or more. The Mo content is preferably 0.3% or less.

Co: 0.01% to 0.5%

Co is an element that improves toughness. This effect is achieved when the Co content is 0.01% or more. If the Co content is more than 0.5%, manufacturability decreases. Accordingly, in the case where Co is contained, the Co content is in the range of 0.01% to 0.5%. The Co content is further preferably 0.02% or more. The Co content is further preferably 0.20% or less.

One or more selected from V: 0.01% to 0.25%, Ti: 0.001% to 0.10%, Nb: 0.001% to 0.10%, Ca: 0.0002% to 0.0020%, Mg: 0.0002% to 0.0050%, B: 0.0002% to 0.0050%, and REM: 0.01% to 0.10%

V: 0.01% to 0.25%

V combines with C and N in the steel, and reduces solute C and N. Thus, V suppresses the precipitation of carbonitride in the hot rolled sheet and prevents the occurrence of linear flaws caused by hot rolling/annealing, to improve surface characteristics. To achieve these effects, the V content needs to be 0.01% or more. If the V content is more than 0.25%, workability decreases, and higher production cost is required. Accordingly, in the case where V is contained, the V content is in the range of 0.01% to 0.25%. The V content is preferably 0.03% or more. The V content is preferably 0.15% or less. The V content is further preferably 0.03% or more. The V content is further preferably 0.05% or less.

Ti: 0.001% to 0.10%, Nb: 0.001% to 0.10%

Ti and Nb are each an element that has high affinity for C and N as with V, and have an effect of precipitating as carbide or nitride during hot rolling and reducing solute C and N in the matrix phase to improve workability after cold-rolled sheet annealing. To achieve this effect, the Ti content needs to be 0.001% or more, and the Nb content needs to be 0.001% or more. If the Ti content or the Nb content is more than 0.10%, the precipitation of excessive TiN or NbC makes it impossible to attain favorable surface characteristics. Accordingly, in the case where Ti is contained, the Ti content is in the range of 0.001% to 0.10%. In the case where Nb is contained, the Nb content is in the range of 0.001% to 0.10%. The Ti content is preferably 0.003% or more. The Ti content is preferably 0.010% or less. The Nb content is preferably 0.005% or more. The Nb content is preferably 0.020% or less. The Nb content is further preferably 0.010% or more. The Nb content is further preferably 0.015% or less.

Ca: 0.0002% to 0.0020%

Ca is an effective component to prevent a nozzle blockage caused by the crystallization of a Ti inclusion, which tends to occur during continuous casting. To achieve this effect, the Ca content needs to be 0.0002% or more. If the Ca content is more than 0.0020%, CaS forms and corrosion resistance decreases. Accordingly, in the case where Ca is contained, the Ca content is in the range of 0.0002% to 0.0020%. The Ca content is preferably 0.0005% or more. The Ca content is preferably 0.0015% or less. The Ca content is further preferably 0.0005% or more. The Ca content is further preferably 0.0010% or less.

Mg: 0.0002% to 0.0050%

Mg is an element that has an effect of improving hot workability. To achieve this effect, the Mg content needs to be 0.0002% or more. If the Mg content is more than 0.0050%, surface quality decreases. Accordingly, in the case where Mg is contained, the Mg content is in the range of 0.0002% to 0.0050%. The Mg content is preferably 0.0005% or more. The Mg content is preferably 0.0035% or less. The Mg content is further preferably 0.0005% or more. The Mg content is further preferably 0.0020% or less.

B: 0.0002% to 0.0050%

B is an element effective in preventing low-temperature secondary working embrittlement. To achieve this effect, the B content needs to be 0.0002% or more. If the B content is more than 0.0050%, hot workability decreases. Accordingly, in the case where B is contained, the B content is in the range of 0.0002% to 0.0050%. The B content is preferably 0.0005% or more. The B content is preferably 0.0035% or less. The B content is further preferably 0.0005% or more. The B content is further preferably 0.0020% or less.

REM: 0.01% to 0.10%

REM (Rare Earth Metals) is an element that improves oxidation resistance, and especially has an effect of suppressing oxide layer formation in a weld and improving the corrosion resistance of the weld. To achieve this effect, the REM content needs to be 0.01% or more. If the REM content is more than 0.10%, manufacturability such as pickling property during cold rolling and annealing decreases. Besides, since REM is an expensive element, excessively adding REM incurs higher production cost, which is not preferable. Accordingly, in the case where REM is contained, the REM content is in the range of 0.01% to 0.10%.

The chemical composition of the ferritic stainless steel according to the disclosure has been described above.

In the chemical composition according to the disclosure, components other than those described above are Fe and incidental impurities.

The following describes a process for producing the ferritic stainless steel according to the disclosure.

Molten steel having the aforementioned chemical composition is obtained by steelmaking using a known method such as a converter, an electric heating furnace, or a vacuum melting furnace, and made into a steel raw material (slab) by continuous casting or ingot casting and blooming.

The slab is heated at 1100° C. to 1250° C. for 1 hours to 24 hours and then hot rolled, or the cast slab is directly hot rolled without heating, into a hot rolled sheet.

The hot rolled sheet is then subjected to hot-rolled sheet annealing by holding the hot rolled sheet at a temperature of 900° C. or more and 1050° C. or less which is a dual phase region temperature of the ferrite phase and the austenite phase for 5 seconds to 15 minutes, to form a hot-rolled and annealed sheet.

In the case where the chemical composition contains C: 0.005% to 0.030%, Si: 0.25% or more and less than 0.40%, and Mn: 0.05% to 0.35% (hereafter also simply referred to as "in the case of chemical composition 1"), it is preferable to perform hot-rolled sheet annealing by holding the hot rolled sheet at a temperature of 940° C. or more and 1000° C. or less for 5 seconds to 15 minutes.

In the case where the chemical composition contains C: 0.005% to 0.025%, Si: 0.05% or more and less than 0.25%, Mn: 0.60% to 0.90%, and N: 0.005% to 0.025% (hereafter also simply referred to as "in the case of chemical composition 2"), it is preferable to perform hot-rolled sheet annealing by holding the hot rolled sheet at a temperature of 960° C. or more and 1050° C. or less for 5 seconds to 15 minutes.

Next, the hot-rolled and annealed sheet is pickled according to need, and then cold rolled into a cold rolled sheet. After this, the cold rolled sheet is subjected to cold-rolled sheet annealing, to form a cold-rolled and annealed sheet. The cold-rolled and annealed sheet is pickled according to need, to form a product.

Cold rolling is preferably performed at a rolling reduction of 50% or more, in terms of elongation property, bendability, press formability, and shape adjustment. In the disclosure, cold rolling and annealing may be performed twice or more. Cold-rolled sheet annealing is performed by holding the cold rolled sheet at a temperature of 800° C. or more and less than 900° C. for 5 seconds to 5 minutes. In the case of the aforementioned chemical composition 1 or 2, it is preferable to hold the cold rolled sheet at a temperature of 820° C. or more and less than 880° C. for 5 seconds to 5 minutes. BA annealing (bright annealing) may be performed to enhance luster.

Moreover, grinding, polishing, etc. may be applied to further improve surface characteristics.

The reasons for limiting the hot-rolled sheet annealing condition and the cold-rolled sheet annealing condition from among the aforementioned production conditions are described below.

Hot-rolled sheet annealing condition: holding the hot rolled sheet at a temperature of 900° C. or more and 1050° C. or less for 5 seconds to 15 minutes Hot-rolled sheet annealing is a very important step to attain excellent formability and ridging resistance in the disclosure. If the holding temperature in the hot-rolled sheet annealing is less than 900° C., recrystallization is insufficient, and also the phase region is the ferrite single phase region, which may make it impossible to achieve the advantageous effects of the disclosure produced by dual phase region annealing. If the holding temperature is more than 1050° C., the volume fraction of the martensite phase generated after the hot-rolled sheet annealing decreases, as a result of which the concentration effect of the rolling strain in the ferrite phase in the subsequent cold rolling is reduced. This causes insufficient ferrite colony destruction, so that predetermined ridging resistance may be unable to be attained.

If the holding time is less than 5 seconds, the generation of the austenite phase and the recrystallization of the ferrite phase are insufficient even when the annealing is performed at the predetermined temperature, so that desired formability may be unable to be attained. If the holding time is more than 15 minutes, the concentration of C in the austenite phase is promoted, which may cause excessive martensite phase generation after the hot-rolled sheet annealing and result in a decrease in hot rolled sheet toughness. The hot-rolled sheet annealing therefore holds the hot rolled sheet at a temperature of 900° C. or more and 1050° C. or less for 5 seconds to 15 minutes. The hot-rolled sheet annealing preferably holds the hot rolled sheet at a temperature of 920° C. or more and 1000° C. or less for 5 seconds to 15 minutes.

In the case of the aforementioned chemical composition 1, it is more preferable to hold the hot rolled sheet at a temperature of 940° C. or more and 1000° C. or less for 5 seconds to 15 minutes. In the case of the aforementioned chemical composition 2, it is more preferable to hold the hot rolled sheet at a temperature of 960° C. or more and 1050° C. or less for 5 seconds to 15 minutes. The upper limit of the holding time is further preferably 5 minutes. The upper limit of the holding time is still further preferably 3 minutes.

Cold-rolled sheet annealing condition: holding the cold rolled sheet at a temperature of 800° C. or more and less than 900° C. for 5 seconds to 5 minutes Cold-rolled sheet annealing is an important step to recrystallize the ferrite phase generated in the hot-rolled sheet annealing and also adjust the volume fraction of the C/N-concentrated grains to a predetermined range. If the holding temperature in the cold-rolled sheet annealing is less than 800° C., recrystallization is insufficient and predetermined elongation after fracture cannot be attained. If the holding temperature in the cold-rolled sheet annealing is 900° C. or more, the martensite phase is generated and the steel sheet hardens, and as a result predetermined elongation after fracture cannot be attained.

If the holding time is less than 5 seconds, the recrystallization of the ferrite phase is insufficient even when the annealing is performed at the predetermined temperature, so that predetermined elongation after fracture cannot be attained. If the holding time is more than 5 minutes, crystal grains coarsen significantly and the brightness of the steel sheet decreases, which is not preferable in terms of surface quality. The cold-rolled sheet annealing therefore holds the cold rolled sheet at a temperature of 800° C. or more and less than 900° C. for 5 seconds to 5 minutes. The cold-rolled sheet annealing preferably holds the cold rolled sheet at a temperature of 820° C. or more and less than 900° C. for 5 seconds to 5 minutes. In the case of the aforementioned chemical composition 1 or 2, it is preferable to hold the cold rolled sheet at a temperature of 820° C. or more and less than 880° C. for 5 seconds to 5 minutes.

EXAMPLES

Each steel whose chemical composition is shown in Table 1 was obtained by steelmaking in a 50 kg small vacuum melting furnace. After heating each steel ingot at 1150° C. for 1 h, the steel ingot was hot rolled into a hot rolled sheet of 3.0 mm in thickness. After the hot rolling, the hot rolled sheet was water cooled to 600° C. and then air cooled. Following this, the hot rolled sheet was subjected to hot-rolled sheet annealing under the condition shown in Table 2, and then descaling was performed on its surface by shot blasting and pickling. The hot rolled sheet was further cold rolled to 0.8 mm in sheet thickness. The cold rolled sheet was subjected to cold-rolled sheet annealing under the condition shown in Table 2, and then descaled by pickling to obtain a cold-rolled and annealed sheet.

The cold-rolled and annealed sheet was evaluated as follows.

(1) Volume Fraction of C/N-Concentrated Grains

The volume fraction of the C/N-concentrated grains was measured using an electron probe microanalyzer (EPMA) (JXA-8200 made by JEOL Ltd.). A test piece of 10 mm in width and 15 mm in length was cut out of the width center part of the cold-rolled and annealed sheet, embedded in resin so as to expose a section in parallel with the rolling direction, and mirror polished on its surface. A microstructure image (reflected electron image) of an area of 200 μm×200 μm was captured in the ¼ sheet thickness part of the embedded sample. Spot analysis was performed on all crystal grains present in the captured area, and the C and N concentrations were measured (accelerating voltage: 15 kV, illumination current: $1\times10^{-7}$ A, spot diameter: 0.5 μm). Upon spot analysis, quantitative values were corrected based on calibration curves measured beforehand with a sample having known C and N contents. After completing the measurement of the C and N concentrations for each crystal grain, the C and N concentrations were compared with the C and N contents (respectively denoted by $C_C$ and $C_N$) in the steel obtained by wet analysis separately, and ferrite crystal grains with a C concentration of $2C_C$ or more and/or an N concentration of $2C_N$ or more were determined as C/N-concentrated grains. The area ratio of the C/N-concentrated grains in the microstructure image was then calculated and set as the volume fraction of the C/N-concentrated grains.

In all Examples, a multi-phase (ferrite phase) of C/N-concentrated grains and non-concentrated grains was obtained, and the structures other than the ferrite phase were less than 1% in volume fraction with respect to the whole volume of the microstructure.

(2) Vickers Hardness

Vickers hardness was evaluated according to JIS Z 2244. A test piece of 10 mm in width and 15 mm in length was cut out of the width center part of the cold-rolled and annealed sheet, embedded in resin so as to expose a section in parallel with the rolling direction, and mirror polished on its surface. The hardness of the ¼ sheet thickness part of the section was measured at 10 points with a load of 1 kgf (≈9.8 N) using a Vickers hardness meter, and the mean value was set as the Vickers hardness of the steel.

(3) Elongation After Fracture

A JIS No. 13B tensile test piece was collected from the cold-rolled and annealed sheet so that the orthogonal direction to the rolling-direction was the longitudinal direction of the test piece, and a tensile test was conducted according to JIS Z 2241 to measure the elongation after fracture. Each test piece with elongation after fracture of 30% or more was accepted (very good) as having very good elongation, each test piece with elongation after fracture of 28% or more was accepted (good) as having good elongation, each test piece with elongation after fracture of 25% or more and less than 28% was accepted (fair), and each test piece with elongation after fracture of less than 25% was rejected.

(4) Ridging Resistance

A JIS No. 5 tensile test piece was collected from the cold-rolled and annealed sheet so that the rolling direction was the longitudinal direction of the test piece. After polishing the surface using #600 emery paper, a tensile test was conducted according to JIS Z 2241, and a tensile strain of 20% was added. The arithmetic mean waviness Wa defined in JIS B 0601 (2001) was then measured by a surface roughness meter on the polished surface at the center of the parallel portion of the test piece in the direction orthogonal to the rolling direction, with a measurement length of 16 mm, a high-cut filter wavelength of 0.8 mm, and a low-cut filter wavelength of 8 mm. Each test piece with Wa of 2.0 μm or less was accepted (good) as having good ridging resistance, each test piece with Wa of more than 2.0 μm and 2.5 μm or less was accepted (fair), and each test piece with Wa of more than 2.5 μm was rejected.

(5) Corrosion Resistance

A test piece of 60 mm×100 mm was collected from the cold-rolled and annealed sheet. After polishing the surface using #600 emery paper, the end surface part of the test piece was sealed, and the test piece was subjected to a salt spray cycle test defined in JIS H 8502. The salt spray cycle test was performed eight cycles each of which involved salt spray (5 mass % NaCl, 35° C., spray 2 h) dry (60° C., 4 h, relative humidity of 40%) wet (50° C., 2 h, relative humidity 95%).

The test piece surface after eight cycles of the salt spray cycle test was photographed, the rusting area of the test piece surface was measured by image analysis, and the rusting ratio ((the rusting area in the test piece)/(the whole area of the test piece)×100%) was calculated from the ratio to the whole area of the test piece. Each test piece with a rusting ratio of 25% or less was accepted, and each test piece with a rusting ratio of more than 25% was rejected.

The evaluation results of the foregoing (1) to (5) are shown in Table 2.

TABLE 1

| Steel | Chemical composition (mass %) | | | | | | | | | | |
|---|---|---|---|---|---|---|---|---|---|---|---|
| ID | C | Si | Mn | P | S | Cr | Ni | Al | N | Others | Remarks |
| AA | 0.021 | 0.16 | 0.80 | 0.022 | 0.004 | 16.4 | 0.12 | 0.003 | 0.035 | — | Conforming steel |
| AB | 0.019 | 0.15 | 0.78 | 0.028 | 0.006 | 16.1 | 0.24 | 0.002 | 0.034 | — | Conforming steel |
| AC | 0.018 | 0.30 | 0.18 | 0.026 | 0.005 | 16.2 | 0.11 | 0.002 | 0.036 | V: 0.04 | Conforming steel |
| AD | 0.028 | 0.26 | 0.21 | 0.031 | 0.005 | 17.4 | 0.10 | 0.003 | 0.015 | — | Conforming steel |
| AE | 0.022 | 0.29 | 0.31 | 0.023 | 0.006 | 16.3 | 0.12 | 0.005 | 0.051 | Mo: 0.4 | Conforming steel |
| AF | 0.022 | 0.26 | 0.22 | 0.033 | 0.005 | 16.2 | 0.08 | 0.003 | 0.042 | — | Conforming steel |
| AG | 0.024 | 0.32 | 0.12 | 0.028 | 0.003 | 16.1 | 0.21 | 0.006 | 0.019 | Ti: 0.04, Ca: 0.0009 | Conforming steel |
| AH | 0.023 | 0.28 | 0.24 | 0.031 | 0.003 | 16.4 | 0.12 | 0.005 | 0.034 | V: 0.09, B: 0.0031 | Conforming steel |
| AI | 0.025 | 0.31 | 0.21 | 0.020 | 0.003 | 16.2 | 0.13 | 0.005 | 0.031 | Mg: 0.0021 | Conforming steel |
| AJ | 0.021 | 0.39 | 0.23 | 0.034 | 0.002 | 16.3 | 0.10 | 0.005 | 0.039 | REM: 0.02 | Conforming steel |
| AK | 0.021 | 0.34 | 0.48 | 0.032 | 0.006 | 16.5 | 0.12 | 0.024 | 0.043 | Cu: 0.4 | Conforming steel |
| AL | 0.020 | 0.58 | 0.39 | 0.029 | 0.005 | 16.7 | 0.10 | 0.004 | 0.031 | Nb: 0.05 | Conforming steel |
| AM | 0.018 | 0.71 | 0.20 | 0.034 | 0.003 | 16.4 | 0.09 | 0.003 | 0.034 | Co: 0.4 | Conforming steel |
| AN | 0.048 | 0.24 | 0.61 | 0.026 | 0.004 | 15.7 | 0.30 | 0.003 | 0.041 | — | Conforming steel |
| AO | 0.012 | 0.14 | 0.81 | 0.034 | 0.002 | 16.4 | 0.12 | 0.003 | 0.037 | — | Conforming steel |
| AP | 0.014 | 0.15 | 0.81 | 0.021 | 0.004 | 16.1 | 0.11 | 0.003 | 0.015 | — | Conforming steel |
| AQ | 0.010 | 0.16 | 0.79 | 0.020 | 0.004 | 16.3 | 0.12 | 0.003 | 0.010 | — | Conforming steel |
| AR | 0.007 | 0.15 | 0.79 | 0.020 | 0.005 | 16.2 | 0.12 | 0.004 | 0.006 | — | Conforming steel |
| AS | 0.015 | 0.16 | 0.80 | 0.021 | 0.004 | 16.2 | 0.11 | 0.004 | 0.016 | Ti: 0.008, Nb: 0.019 | Conforming steel |
| AT | 0.015 | 0.15 | 0.78 | 0.020 | 0.005 | 16.1 | 0.10 | 0.004 | 0.015 | Cu: 0.04 V: 0.05 | Conforming steel |
| BA | 0.003 | 0.31 | 0.21 | 0.031 | 0.005 | 16.6 | 0.10 | 0.004 | 0.020 | — | Comparative steel |
| BB | 0.016 | 0.29 | 0.20 | 0.031 | 0.003 | 16.1 | 0.12 | 0.003 | 0.004 | — | Comparative steel |
| BC | 0.062 | 0.26 | 0.29 | 0.034 | 0.006 | 16.2 | 0.15 | 0.003 | 0.067 | — | Comparative steel |
| BD | 0.022 | 1.13 | 0.32 | 0.030 | 0.004 | 16.7 | 0.10 | 0.003 | 0.034 | — | Comparative steel |
| BE | 0.022 | 0.29 | 1.07 | 0.030 | 0.004 | 16.7 | 0.09 | 0.003 | 0.037 | — | Comparative steel |
| BF | 0.022 | 0.31 | 0.25 | 0.031 | 0.006 | 15.3 | 0.10 | 0.003 | 0.039 | — | Comparative steel |
| BG | 0.024 | 0.34 | 0.24 | 0.028 | 0.005 | 18.4 | 0.15 | 0.004 | 0.037 | — | Comparative steel |

Note:

underlined value is outside the appropriate range.

TABLE 2

| No. | Steel ID | Hot-rolled sheet annealing condition: Holding temperature (° C.) | Hot-rolled sheet annealing condition: Holding time (sec) | Cold-rolled sheet annealing condition: Holding temperature (° C.) | Cold-rolled sheet annealing condition: Holding time (sec) | Volume fraction of C/N-concentrated grains (%) | Vickers hardness (Hv1.0) | Elongation after fracture | Ridging resistance | Corrosion resistance | Remarks |
|---|---|---|---|---|---|---|---|---|---|---|---|
| 1 | AA | 920 | 60 | 810 | 60 | 18 | 164 | Accepted (fair) | Accepted (good) | Accepted | Example |
| 2 | | 980 | 60 | 860 | 60 | 27 | 172 | Accepted (fair) | Accepted (good) | Accepted | Example |
| 3 | | 980 | 60 | 890 | 60 | 25 | 175 | Accepted (fair) | Accepted (good) | Accepted | Example |
| 4 | | 1020 | 60 | 860 | 60 | 34 | 174 | Accepted (fair) | Accepted (good) | Accepted | Example |
| 5 | AB | 920 | 60 | 810 | 60 | 24 | 168 | Accepted (fair) | Accepted (good) | Accepted | Example |
| 6 | AC | 920 | 60 | 810 | 60 | 14 | 164 | Accepted (fair) | Accepted (fair) | Accepted | Example |
| 7 | | 980 | 60 | 860 | 60 | 18 | 166 | Accepted (good) | Accepted (good) | Accepted | Example |
| 8 | AD | 980 | 60 | 860 | 60 | 14 | 162 | Accepted (good) | Accepted (fair) | Accepted | Example |
| 9 | AE | 980 | 60 | 860 | 60 | 29 | 178 | Accepted (good) | Accepted (good) | Accepted | Example |
| 10 | AF | 980 | 60 | 860 | 60 | 30 | 179 | Accepted (good) | Accepted (good) | Accepted | Example |
| 11 | AG | 980 | 60 | 860 | 60 | 18 | 165 | Accepted (good) | Accepted (fair) | Accepted | Example |
| 12 | AH | 980 | 60 | 860 | 60 | 15 | 164 | Accepted (good) | Accepted (fair) | Accepted | Example |
| 13 | AI | 980 | 60 | 860 | 60 | 15 | 162 | Accepted (good) | Accepted (fair) | Accepted | Example |
| 14 | AJ | 980 | 60 | 860 | 60 | 16 | 162 | Accepted (good) | Accepted (good) | Accepted | Example |
| 15 | AK | 980 | 60 | 860 | 60 | 28 | 173 | Accepted (fair) | Accepted (good) | Accepted | Example |
| 16 | AL | 980 | 60 | 860 | 60 | 14 | 163 | Accepted (fair) | Accepted (fair) | Accepted | Example |
| 17 | AM | 980 | 60 | 860 | 60 | 7 | 159 | Accepted (fair) | Accepted (fair) | Accepted | Example |
| 18 | AN | 980 | 60 | 860 | 60 | 45 | 169 | Accepted (fair) | Accepted (good) | Accepted | Example |
| 19 | AO | 980 | 60 | 860 | 60 | 14 | 161 | Accepted (fair) | Accepted (fair) | Accepted | Example |
| 20 | AP | 1000 | 60 | 840 | 60 | 10 | 158 | Accepted (very good) | Accepted (fair) | Accepted | Example |
| 21 | AQ | 1000 | 60 | 840 | 60 | 8 | 156 | Accepted (very good) | Accepted (fair) | Accepted | Example |
| 22 | AR | 1000 | 60 | 840 | 60 | 6 | 154 | Accepted (very good) | Accepted (fair) | Accepted | Example |
| 23 | AS | 1000 | 60 | 840 | 60 | 8 | 158 | Accepted (very good) | Accepted (fair) | Accepted | Example |
| 24 | AT | 1000 | 60 | 840 | 60 | 7 | 154 | Accepted (very good) | Accepted (fair) | Accepted | Example |
| 25 | BA | 980 | 60 | 860 | 60 | 1 | 151 | Accepted (very good) | Rejected | Accepted | Comparative Example |
| 26 | BB | 980 | 60 | 860 | 60 | 2 | 159 | Accepted (very good) | Rejected | Accepted | Comparative Example |
| 27 | BC | 980 | 60 | 860 | 60 | 58 | 174 | Rejected | Accepted (fair) | Rejected | Comparative Example |
| 28 | BD | 980 | 60 | 860 | 60 | 0 | 161 | Rejected | Rejected | Accepted | Comparative Example |
| 29 | BE | 980 | 60 | 860 | 60 | 11 | 157 | Accepted (fair) | Accepted (fair) | Rejected | Comparative Example |
| 30 | BF | 980 | 60 | 860 | 60 | 28 | 157 | Accepted (good) | Accepted (fair) | Rejected | Comparative Example |
| 31 | BG | 980 | 60 | 860 | 60 | 3 | 167 | Accepted (fair) | Rejected | Accepted | Comparative Example |
| 32 | AA | 800 | 30000 | 840 | 60 | 0 | 158 | Accepted (good) | Rejected | Accepted | Comparative Example |
| 33 | | 860 | 60 | 840 | 60 | 3 | 167 | Accepted (fair) | Rejected | Accepted | Comparative Example |
| 34 | | 980 | 60 | 760 | 60 | 21 | 271 | Rejected | Accepted (fair) | Accepted | Comparative Example |
| 35 | | 980 | 60 | 960 | 60 | 14 | 185 | Rejected | Accepted (fair) | Accepted | Comparative Example |

TABLE 2-continued

| No. | Steel ID | Hot-rolled sheet annealing condition: Holding temperature (° C.) | Hot-rolled sheet annealing condition: Holding time (sec) | Cold-rolled sheet annealing condition: Holding temperature (° C.) | Cold-rolled sheet annealing condition: Holding time (sec) | Volume fraction of C/N-concentrated grains (%) | Vickers hardness (Hv1.0) | Elongation after fracture | Ridging resistance | Corrosion resistance | Remarks |
|---|---|---|---|---|---|---|---|---|---|---|---|
| 36 | AC | 800 | 30000 | 840 | 60 | 0 | 154 | Accepted (good) | Rejected | Accepted | Comparative Example |
| 37 | | 860 | 60 | 840 | 60 | 3 | 163 | Accepted (fair) | Rejected | Accepted | Comparative Example |
| 38 | | 980 | 60 | 760 | 60 | 18 | 254 | Rejected | Accepted (fair) | Accepted | Comparative Example |
| 39 | | 980 | 60 | 960 | 60 | 16 | 201 | Rejected | Accepted (fair) | Accepted | Comparative Example |

Note:
underlined value is outside the appropriate mnge.

As shown in Table 2, all Examples were excellent in formability and ridging resistance and also excellent in corrosion resistance.

In Comparative Examples No. 25 and No. 26, the C content or the N content was below the appropriate range, so that the volume fraction of the C/N-concentrated grains was lower and the ridging resistance was poor. In Comparative Example No. 27, the C content and the N content were each above the appropriate range, so that the volume fraction of the C/N-concentrated grains was above the appropriate range and not only the elongation after fracture but also the corrosion resistance was poor.

In Comparative Example No. 28, the Si content was above the appropriate range, so that the elongation after fracture was poor. Besides, the generation of the martensite phase during the hot-rolled sheet annealing was insufficient, and so the ridging resistance was poor. In Comparative Example No. 29, the Mn content was above the appropriate range, so that the corrosion resistance was poor. In Comparative Example No. 30, the Cr content was below the appropriate range, so that the corrosion resistance was poor. In Comparative Example No. 31, the Cr content was above the appropriate range, so that the volume fraction of the C/N-concentrated grains was below the appropriate range and the ridging resistance was poor.

In Comparative Examples No. 32 and No. 36, the holding temperature and holding time in the hot-rolled sheet annealing were each outside the appropriate range, and the amount of martensite phase generated in the hot-rolled sheet annealing was insufficient, and therefore the ridging resistance was poor. In Comparative Examples No. 33 and No. 37, the holding temperature in the hot-rolled sheet annealing was below the appropriate range, so that the volume fraction of the C/N-concentrated grains in the cold-rolled and annealed sheet was insufficient and the ridging resistance was poor.

In Comparative Examples No. 34 and No. 38, the holding temperature in the cold-rolled sheet annealing was below the appropriate range, so that recrystallization was insufficient and the hardness was high, and the elongation after fracture was poor. In Comparative Examples No. 35 and No. 39, the holding temperature in the cold-rolled sheet annealing was above the appropriate range, so that hard martensite phase was generated to cause high hardness, and the elongation after fracture was poor.

These results demonstrate that stainless steel having excellent ridging resistance and formability and also having excellent corrosion resistance can be obtained according to the disclosure.

INDUSTRIAL APPLICABILITY

The ferritic stainless steel according to the disclosure is particularly suitable for press formed parts mainly made by bulging and other uses where high surface aesthetics is required, such as kitchen utensils and eating utensils.

The invention claimed is:

1. A ferritic stainless steel comprising:
a chemical composition consisting of, in mass %,
C: 0.005% to 0.050%,
Si: 0.01% to 1.00%,
Mn: 0.01% to 1.0%,
P: 0.040% or less,
S: 0.010% or less,
Cr: 15.5% to 17.5%,
Ni: 0.01% to 1.0%,
Al: 0.001% to 0.10%, and
N: 0.005% to 0.06%,
and optionally
one or more selected from Cu: 0.01% to 1.0%, Mo: 0.01% to 0.5%, and Co:
0.01% to 0.5%,
and optionally
one or more selected from V: 0.01% to 0.25%, Ti: 0.001% to 0.10%, Nb: 0.001% to 0.05%, Ca: 0.0002% to 0.0020%, Mg: 0.0002% to 0.0050%, B: 0.0002% to 0.0050%, and REM: 0.01% to 0.10%,
with a balance being Fe and incidental impurities;
a microstructure containing ferrite crystal grains which satisfy at least one of a C concentration of $2C_C$ or more and an N concentration of $2C_N$ or more, the ferrite crystal grains having a volume fraction with respect to a whole volume of the microstructure of 5% or more and 50% or less, where $C_C$ and $C_N$ are respectively C content and N content in the steel in mass %; and
a Vickers hardness of 180 or less.

2. The ferritic stainless steel according to claim 1, wherein in the chemical composition, Cu content is 0.01% to 0.5%.

3. The ferritic stainless steel according to claim 2, wherein in the chemical composition, Mo content is 0.01% to 0.3%.

4. The ferritic stainless steel according to claim 1, wherein in the chemical composition, Mo content is 0.01% to 0.3%.

5. The ferritic stainless steel according to claim 1, wherein in the chemical composition, C content is 0.005 mass % to 0.030 mass %, Si content is 0.25 mass % or more and less than 0.40 mass %, and Mn content is 0.05 mass % to 0.35 mass %, the volume fraction of the ferrite crystal grains is 5% or more and 30% or less, and the ferritic stainless steel further comprises elongation after fracture in a direction orthogonal to a rolling direction is 28% or more, and a ridging height is 2.5 μm or less.

6. The ferritic stainless steel according to claim 1, wherein in the chemical composition, C content is 0.005 mass % to 0.025 mass %, Si content is 0.05 mass % or more and less than 0.25 mass %, Mn content is 0.60 mass % to 0.90 mass %, and N content is 0.005 mass % to 0.025 mass %, the volume fraction of the ferrite crystal grains is 5% or more and 20% or less, and the ferritic stainless steel further comprises elongation after fracture in a direction orthogonal to a rolling direction is 30% or more, and a ridging height is 2.5 μm or less.

7. A process for producing the ferritic stainless steel according to claim 1, the process comprising:

hot rolling a steel slab having the chemical composition according to claim 1 into a hot rolled sheet;

performing hot-rolled sheet annealing by holding the hot rolled sheet at a temperature of 900° C. or more and 1050° C. or less for 5 seconds to 15 minutes, to form a hot-rolled and annealed sheet;

cold rolling the hot-rolled and annealed sheet into a cold rolled sheet; and performing cold-rolled sheet annealing by holding the cold rolled sheet at a temperature of 800° C. or more and less than 900° C. for 5 seconds to 5 minutes.

8. A process for producing the ferritic stainless steel according to claim 5, the process comprising:

hot rolling a steel slab having the chemical composition according to claim 5 into a hot rolled sheet;

performing hot-rolled sheet annealing by holding the hot rolled sheet at a temperature of 940° C. or more and 1000° C. or less for 5 seconds to 15 minutes, to form a hot-rolled and annealed sheet;

cold rolling the hot-rolled and annealed sheet into a cold rolled sheet; and performing cold-rolled sheet annealing by holding the cold rolled sheet at a temperature of 820° C. or more and less than 880° C. for 5 seconds to 5 minutes.

9. A process for producing the ferritic stainless steel according to claim 6, the process comprising:

hot rolling a steel slab having the chemical composition according to claim 6 into a hot rolled sheet;

performing hot-rolled sheet annealing by holding the hot rolled sheet at a temperature of 960° C. or more and 1050° C. or less for 5 seconds to 15 minutes, to form a hot-rolled and annealed sheet;

cold rolling the hot-rolled and annealed sheet into a cold rolled sheet; and performing cold-rolled sheet annealing by holding the cold rolled sheet at a temperature of 820° C. or more and less than 880° C. for 5 seconds to 5 minutes.

* * * * *